US005564949A

United States Patent [19]

Wellinsky

[11] Patent Number: 5,564,949

[45] Date of Patent: Oct. 15, 1996

[54] SHIELDED COMPACT DATA CONNECTOR

[75] Inventor: Wayne T. Wellinsky, Moore, S.C.

[73] Assignee: Thomas & Betts Corporation, Memphis, Tenn.

[21] Appl. No.: 369,058

[22] Filed: Jan. 5, 1995

[51] Int. Cl.[6] ..... H01R 13/648

[52] U.S. Cl. ..... 439/607; 439/608

[58] Field of Search ..... 439/607, 608, 439/609, 701

[56] References Cited

U.S. PATENT DOCUMENTS

| | | | |
|---|---|---|---|
| 4,451,107 | 5/1984 | Dola et al. . | |
| 4,659,163 | 4/1987 | Althouse et al. . | |
| 4,838,811 | 6/1989 | Nakamura et al. | 439/607 |
| 4,983,127 | 1/1991 | Kawai et al. | 439/79 |
| 4,986,779 | 1/1991 | Ferrill et al. | 439/108 |
| 5,052,948 | 10/1991 | Hyzin | 439/607 |
| 5,066,236 | 11/1991 | Broeksteeg | 439/79 |
| 5,108,300 | 4/1992 | Weber | 439/188 |
| 5,135,405 | 8/1992 | Fusselman et al. | 439/608 X |
| 5,169,343 | 12/1992 | Andrews | 439/608 |
| 5,190,479 | 3/1993 | Jordi | 439/620 |
| 5,228,871 | 7/1993 | Goodman | 439/607 |

*Primary Examiner*—Khiem Nguyen

*Attorney, Agent, or Firm*—Michael L. Hoelter; Salvatore J. Abbruzzese

[57] ABSTRACT

A shielded electrical connector provides continuous ground shielding about the connector. The connector includes a plurality of electrical contacts having contact tails. An insulative body insertably supports the contacts. A conductive housing having an open end is positioned over the insulative body, the contact tails extend outwardly of the conductive housing. An end shield is positioned adjacent the open end of the conductive housing. The end shield surrounds the contact tails providing shielding therebetween and is in interlocking engagement with the conductive housing thereby establishing electrical ground path continuity between the conductive housing and the end shield.

15 Claims, 2 Drawing Sheets

SHIELDED COMPACT DATA CONNECTOR

FIELD OF THE INVENTION

The present invention relates generally to shielded electrical data connectors. More particularly, the present invention relates to a compact data connector having improved electrical characteristics by providing a continuous ground shield about the connector which provides for external connector shielding and which additionally shields the contacts supported within the connector.

BACKGROUND OF THE INVENTION

Recent improvements in electrical data transmission, especially in the computer field, have resulted in the ability to transmit data along transmission lines at increasingly higher data rates. Further, similar improvements have also seen the decrease in the size of the equipment used in the industry. In order to function effectively with such equipment, the interconnection technology, such as the electrical cables and electrical connectors which connect such equipment, has also undergone significant improvements. Electrical connectors are now smaller and capable of transmitting data at higher rates between such components.

The requirement to make the electrical connectors smaller necessitates putting the conductive contacts of such connectors in closer proximity. However, when transmitting data at higher data rates, this physical proximity has a tendency to increase the cross-talk levels between adjacent electrical contacts supported in the connector. Such cross-talk may adversely effect the electrical performance of the connector. Thus, effective internal shielding must be provided as between selected contacts supported within the connector.

Similarly, these electrical connectors may be used in areas which may be subjected to externally induced interferences from other components, radio frequency interference (RFI) and electromagnetic interference (EMI) may also adversely effect connector performance. Accordingly, the industry has also seen the need for improving electrical shielding of the connectors so as to shield such connectors from these external interferences.

The need for effective shielding both internally and externally, is especially seen in connectors used in closed-loop data systems which provide for continuity of signal in a multi-component system when certain of the connectors are not interconnected. These closed-loop systems employ connectors containing devices which permit automatic shunting so that a closed-loop connection is maintained even when a connector is in a non-connected condition. The shunting devices used in these connectors render effective shielding even more problematic.

Further, as shielding is to be provided both internally and externally, ground continuity between the internal and external shielding is desirable. These connectors should provide a continuous ground path between the external and internal shields.

It is, therefore, desirable to provide an electrical connector which provides for continuous shielding in a compact connector design which shields selected contacts supported within the connector as well as shields the connector from outside interferences.

SUMMARY OF THE INVENTION

It is an object of the present invention to provide an improved compact shielded electrical data connector.

It is a further object of the present invention to provide a shielded data connector which shields the connector from external interferences.

It is a still further object of the present invention to provide a shielded data connector which provides effective contact shielding so as to reduce cross-talk between selected contacts supported within the connector.

It is yet a further object of the present invention to provide reliable continuous ground path continuity between the internal and external shielding of an assembled electrical connector.

In the efficient attainment of these and other objects, the present invention provides a shielded electrical connector. The connector includes a plurality of electrical contacts, each of the contacts includes extending contact tails. An insulative body insertably accommodates and supports the contacts therein. A conductive housing having an open end is positioned over the insulative body and provides for external shielding of the connector. The contact tails are positioned to extend out from the open end of the conductive housing. An end shield is positioned adjacent the open end of the conductive housing. The end shield surrounds the contact tails providing shielding therebetween and is in interlocking engagement with the conductive housing for establishing electrical ground path continuity between the conductive housing and the end shield.

As more particularly described by way of the preferred embodiment herein, the conductive housing includes a pair of sidewalls supporting the insulative body therebetween. A slot is formed in each sidewall of the conductive housing. The end shield includes a pair of shield protrusions. Upon assembly of the end shield to the conductive housing the protrusions are insertable into the slots and are held therein in an interference relationship to mechanically and electrically connect the end shield to the conductive housing thereby providing a continuous ground path around the connector. The end shield also provides for the shielding of the contact tails so as to reduce cross-talk between contacts.

DETAILED DESCRIPTION OF THE PREFERRED EMBODIMENTS

Figure 1:
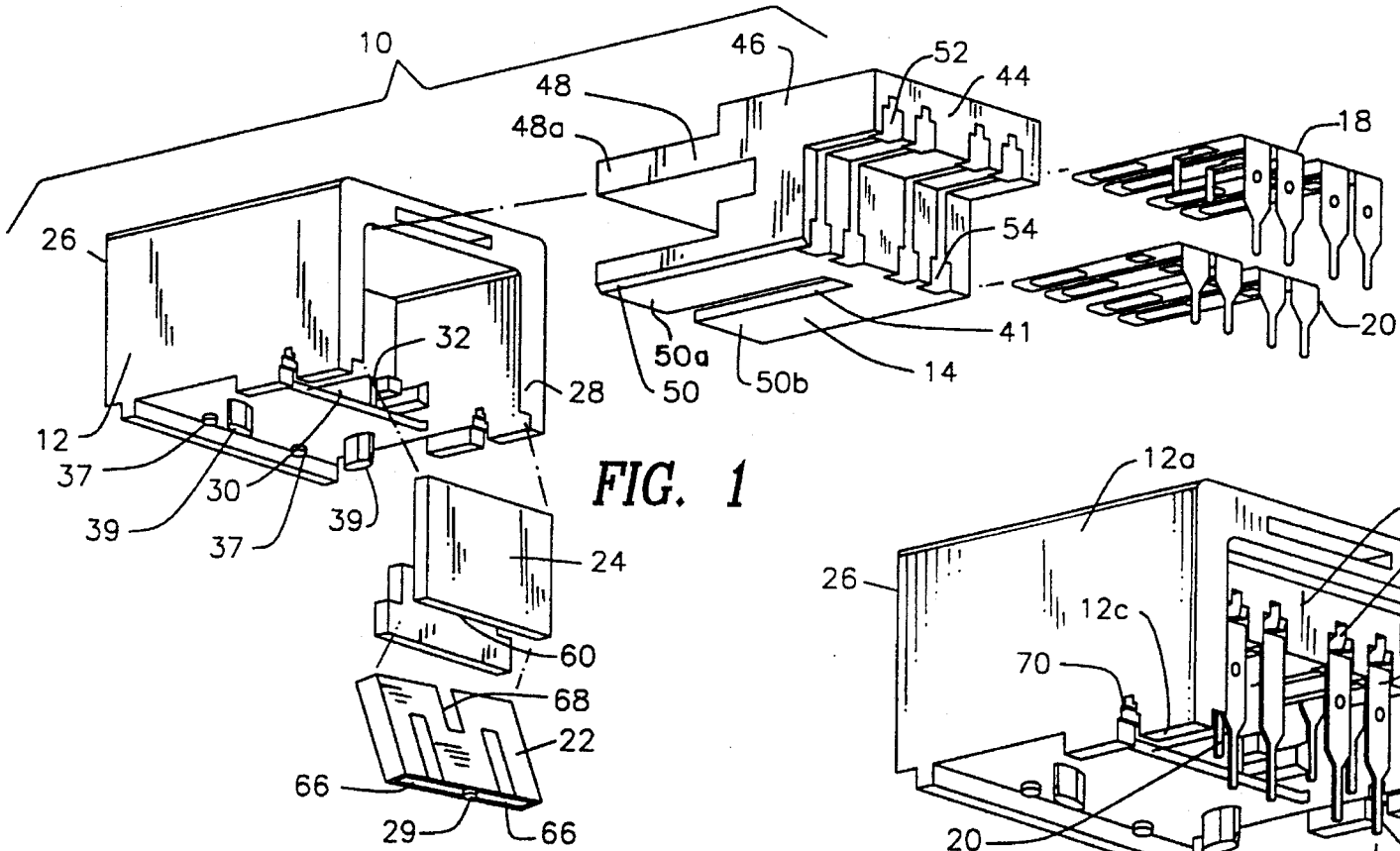
FIG. 1 shows in exploded bottom perspective view, the compact shielded data connector assembly of the present invention.

Referring to the drawings, a shielded compact electrical data connector assembly 10 of the present invention is shown. Data connector assembly 10 is of the type used to transmit data signals between components of a closed loop data system. Connector assembly 10 may be constructed to function generally in a hermaphroditic fashion, that is, it is interconnectable to a similarly shaped electrical connector assembly. Alternately, it may function in a panel mount environment where plural such connector assemblies are supported on a wiring panel for connection with similarly formed electrical connectors. Connector assembly 10 of the present invention is of a type similar to that shown and described in U.S. patent application Ser. No. 08/092,049 filed on Jul. 14, 1993 and entitled "Shielded Compact Data Connector" which is assigned to the assignee of the present invention and which is incorporated by reference herein for all purposes.

Connector assembly 10 comprises an electrically conductive outer housing 12, an electrically insulative contact support member 14, upper and lower rows of electrical contacts 18 and 20 respectively, an insulative rear contact tail support 22 and a rear conductive shield 24. Conductive outer housing 12 and conductive rear shield 24 are formed, in the preferred embodiment, of a suitably conductive metal such as die-cast zinc, however, other conductive elements such as conductive plastic or metallized plastic, may also be employed. Support member 14 as well as rear contact tail support 22 are formed of a suitably electrically insulative plastic such as polyester. Electrical contacts 18 and 20 are formed of a suitably conductive metallic material such as beryllium-copper.

Outer housing 12 is generally an elongate rectangular member having a front interconnection end 26 and an open rear contact accommodating end 28. Outer housing 12 iS divided into discrete bounded compartments 30 internally thereof adjacent the interconnection end 26. Such compartments 30 are formed by a central vertical dividing wall 34 as well as a transverse dividing wall 32 (FIG. 3) which are preferably, but not necessarily integrally formed with outer housing 12. As described in the above incorporated patent application, the construction of outer housing 12 provides individual perimetrically bounded compartments 30 for accommodation of pairs of contacts 18 and 20 in an electrically shielded manner.

Figure 3:
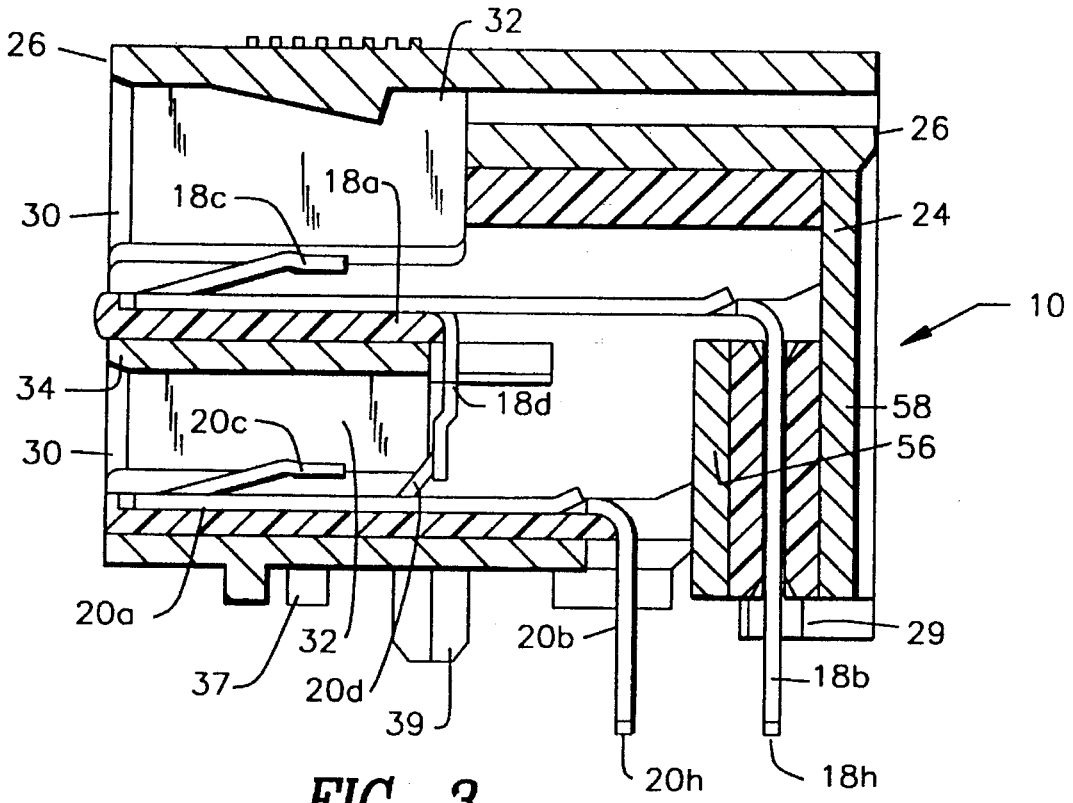
FIG. 3 shows in vertical section, the connector assembly of FIG. 1.

Contact support member 14 is generally an elongate molded plastic member having a generally open rear contact accommodating end 44, a central main body portion 46 and forwardly extending upper and lower support platforms 48 and 50 extending oppositely from rear contact accommodating end 44. Support member 14 includes a row of side-by-side upper channels 52 extending from rear contact accommodating end 44 through central main body portion 46 and along upper support platform 48. Similarly a row of side-by-side lower channels 54 extend from rear contact accommodating end 44 through central main body 46 and along lower support platform 50. Support member 14 is generally transversely divided into side-by-side portions 48*a*, 48*b* and 50*a*, 50*b*, by a passage 41 which extends partially through both support platforms 48 and 50. Passage 41 permits accommodation therein of central vertical dividing wall 34 of outer housing 12. Similarly, transverse wall 32 iS accommodated beneath the lower surface of upper support platform 48 (FIG. 3). In this manner each portion 48*a*, 48*b* and 50*a*, 50*b* of support platforms 48 and 50 is individually accommodated within one of bounded compartments 30.

Upper and lower electrical contacts 18 and 20 are typically stamped and formed metallic members. As shown in FIG. 3, lower contacts 20 include a generally elongate base portion 20*a*, a pin type solder tail 20*b* and a reversely directed cantilevered spring portion 20*c* which extends back over base portion 20*a*. Solder tail 20*b* is of conventional construction and may be inserted into a through-hole of a printed circuit board (not shown) and soldered thereto establishing electrical connection therebetween. In the present illustrative embodiment, solder tail 20*b* is shown extending downwardly at a right angle from base portion 20*a*. However, straight solder tails may also be employed in accordance with the present invention. Cantilevered spring portion 20*c* is constructed so as to be deflectable for movement toward and away from base portion 20*a* upon interconnection with contacts of a mating connection device.

Upper contacts 18 are of construction similar to that of contacts 20. Contacts 18 include an elongate base portion 18*a*, a solder tail 18*b* and a reversely directed cantilevered spring portion 18*c*. As contacts 18 and 20 are arranged in upper and lower fashion, solder tails 18*b* of contacts 18 are longer than solder tails 20*b* of contacts 20 so that the distal extents 18*h* and 20*h* of solder tails extend approximately the same distance, facilitating connection of the solder tails into a planar printed circuit board. As more fully described in the above-referenced incorporated patent application, each upper contact 18 may include a depending shunt member 18*d* which is engagable with a shunt engagement portion 20*d* of each contact 20. Thus, the upper contacts 18 may be shunted to lower contacts 20 so as to effectively function in a closed-loop environment.

Referring additionally again to FIG. 1, contacts 18 and 20 are supported by support member 14 within upper and lower channels 52 and 54 thereof. Base portions 18*a* and 20*a* are supported respectively on platforms 48 and 50 with a pair of contacts being supported on each of platform portions 48*a*, 48*b* and 50*a*, 50*b*. Solder tails 18*b* and 20*b* extend along rear contact accommodating end 44 of support member 14. Support member 14, supporting upper and lower contacts 18 and 20, is inserted into outer housing 12. As outer housing 12 is formed of an electrical conductive material it provides effective electrical shielding from external interferences. Further, the arrangement of portions 48*a*, 48*b* and 50*a*, 50*b* of the support platforms 4s and 50, provides for the support of adjacent pairs of contacts within individual compartments 30. In this manner, adjacent pairs of contacts are electrically shielded from one another effectively reducing cross-talk between contact pairs both vertically and horizontally within connector assembly 10.

The shielding of contacts 18 and 20 is continued at the contact accommodating end 28 of housing 12 by rear shield 24. As shown additionally in FIG. 2, shield 24 is formed of conductive metal and includes a short forward wall 56 and a taller rear wall 58 separated by a centrally located transverse web 60 (FIG. 1). The construction of shield 24 provides conductive shielding as between solder tails 18*b* of upper contacts and solder tails 20*b* of lower contacts. This is achieved by positioning solder tails 20*b* on one side of forward wall 56 while solder tails 18*b* are positioned on the other side of forward wall 56. Solder tails 18*b* reside between walls 56 and 58 (FIG. 3).

In order to provide electrical isolation between the contact tails, connector assembly 10 includes insulative contact tail support 22. Contact tail support 22 is a plastic member which is generally of rectangular shape and includes individual chambers 66 therein which accommodate solder tails 18*b* of contacts 18. Contact tail support 22 includes an upwardly opening recess 68 for accommodation of web 60 of shield 24 when contact 22 iS supported between walls 56 and 58. Contact support 22 may include a depending locating post 29 which, in conjunction with similarly formed locating posts 37 extending from conductive housing 12, help properly position and locate connector assembly 10 on the printed circuit board. Additional posts 39 may be used to provide keyed insertion of connector assembly 10 to the printed circuit board.

Rear shield 24 provides for electrical shielding between contact tails 18*b* and 20*b* extending from connector assembly 10. Together with the construction of the front interconnection end 26 of outer housing 12, effective continuous electrical shielding is provided between pairs of contacts 18 and 20 within connector assembly 10. In order to maintain conductive ground path continuity between outer housing 12, which also shields connector assembly 10 from external interferences, and rear shield 24 which provide shielding between contact tails, rear shield 24 iS mechanically and electrically secured to outer housing 12.

Figure 2:
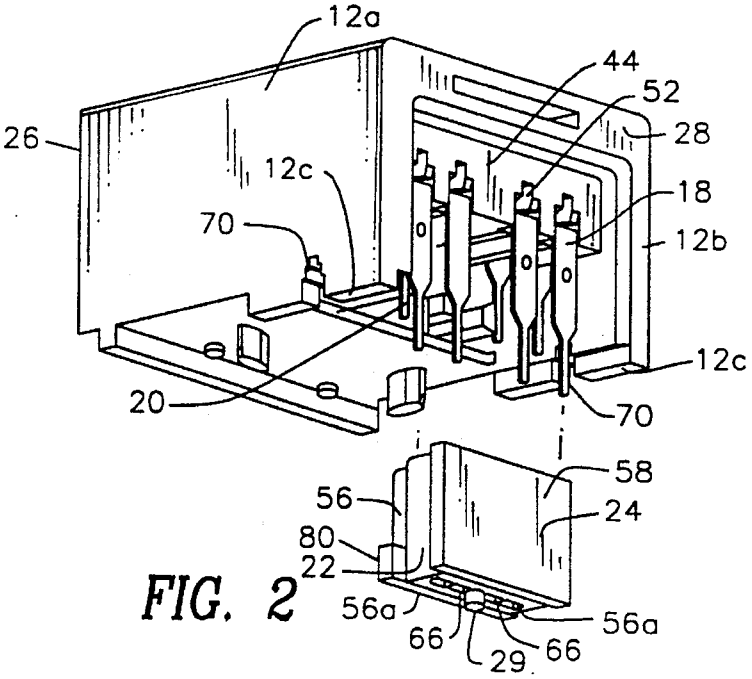
FIG. 2 is a rear, partially exploded perspective view of the connector assembly shown in FIG. 1.
Figure 4:
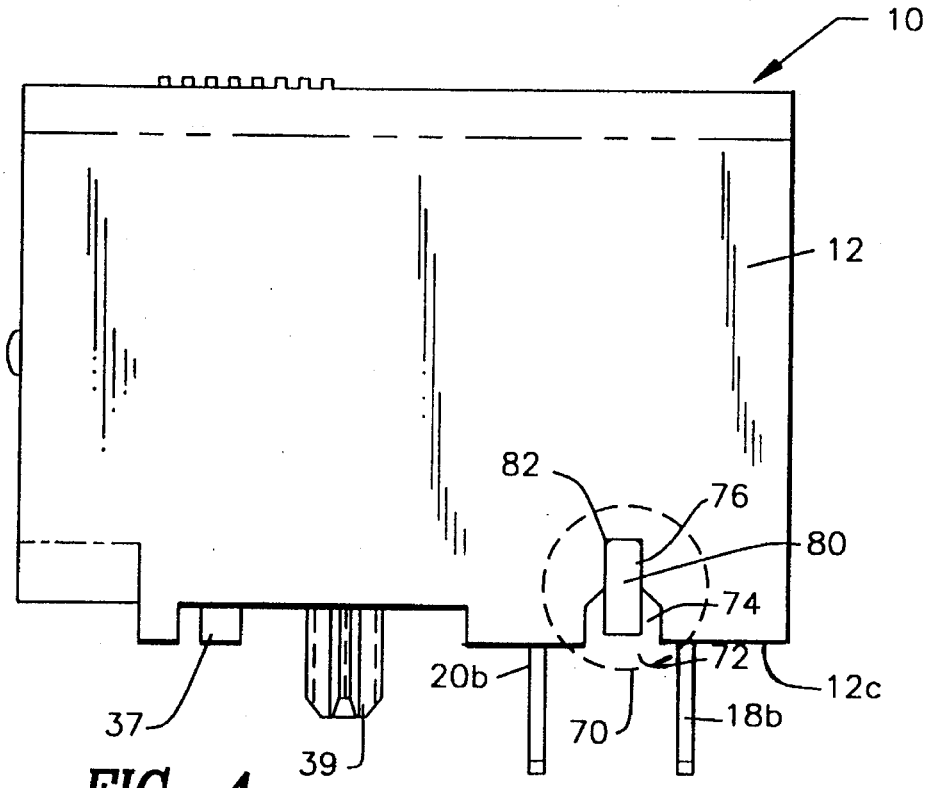
FIG. 4 is a side elevational showing of the connector assembly of FIG. 3.

Outer housing 12 includes opposed sidewalls 12*a* and 12*b* which include transversely aligned open ended notches 70 extending from a lower edge 12*c* thereof. As more particularly shown in FIG. 4, notch 70 includes an open end 72 having a generally uniform transverse extent. Notch 70 then includes an inwardly tapered portion 74 terminating in a narrow notch portion 76 of uniform width. As shown in FIG. 2, short forward wall 56 of shield 24 includes outwardly projecting ear portions 80 extending adjacent a lower edge 56*a* thereof. Ear portions 80 have a generally rectangular cross section having slightly rounded upper corners 82 as shown in FIG. 4. The transverse extent of ear portions 80 is constructed to be equal to or slightly greater than the transverse extent of narrow portion 76 of notch 70. Notch 70 which is positioned on sidewalls 12*a* and 12*b* to accommodate extending ear portions 80 upon attachment of rear shield 24 to housing 12, accommodates each ear portion in frictional engagement. The wider open ends 72 of each notch 70 facilitate insertion of ear portions 80 thereinto. Tapered portion 74 leads ear portions 80 into narrow portion 76 where it is accommodated therein in an interference fit relationship. This frictional engagement provides tight metal-to-metal contact between housing 12 and shield 24. Thus, shield 24 is electrically commoned to housing 12 establishing ground path continuity therebetween. As connector housing 12 and shield 24 are formed of similar metals it is contemplated that the tight interference engagement therebetween will be maintained throughout use of the connector. Thus, the present invention provides shielding as between selected contacts supported therein along the entire extents thereof and also provides ground path continuity with conductive housing 12 shielding connector assembly 10 from external interferences.

Various changes to the foregoing described and shown structures would now be evident to those skilled in the art. Accordingly, the particularly disclosed scope of the invention is set forth in the following claims.

We claim:

1. A shielded electrical connector comprising:

a plurality of electrical contacts, said contacts including extending contact tails;

an insulative body insertably accommodating said contacts;

a conductive housing including opposed sidewalls which support therebetween said insulative body and defining therebetween an open end through which said contact tails extend; and a conductive end shield insertably accommodated in said open end of said conductive housing, said end shield including a first shield wall closing said open end and a second shield wall separating said contact tails;

said conductive end shield including an ear portion extending from one of said shield walls and said conductive housing having a slot formed in one of said walls for reception of said extending ear portion of said conductive end shield upon insertable accommodation of said end shield in said open end of said conductive housing, said ear portion being insertable into said slot in interference relationship to mechanically and electrically connect said end shield to said conductive housing, thereby establishing ground path continuity between said conductive housing and said end shield.

2. A shielded electrical connector of claim 1 wherein said slot is an elongate open ended slot having an inwardly tapered extent for frictional receipt of said shield extending portion.

3. A shielded electrical connector or claim 1 wherein said slot has a given transverse dimension and wherein said ear portion has transverse dimension equal to or greater than said given transverse dimension.

4. A shielded electrical connector of claim 1 further including a contact tail insulator positioned adjacent said contact tails for electrically isolating said contact tails.

5. A shielded electrical connector of claim 4 wherein said end shield supports said contact tail insulator.

6. A shielded electrical connector of claim 5 wherein said second end shield wall is spaced from and generally parallel to said first shield wall, said contact tail insulator being supported between said first and second shield walls.

7. A shielded electrical connector of claim 6 wherein said first shield wall encloses said open end of said conductive housing.

8. A shielded electrical connector of claim 7 wherein said second shield wall includes said extending ear portion.

9. A shielded electrical connector of claim 8 wherein each said sidewall includes one said slot therein and wherein said second shield wall includes an opposed pair of said extending ear portions, each extending ear portion of said pair being insertable into one of said slots.

10. A shielded right angle electrical connector comprising:

a plurality of elongate electrical contacts each said contact having an interconnection extent for electrical connection with mating contact and a termination extent disposed at a right angle with respect to said interconnection extent;

an insulative connector body insertably supporting said electrical contacts;

an electrically conductive housing insertably supporting said body, said conductive housing including a pair of spaced apart sidewalls defining an open end therebetween adjacent said contact termination extents; and a contact shield positioned between said sidewalls adjacent to and enclosing said open end of said conductive housing, said contact shield permitting passage therethrough of said termination extents of said contacts;

said contact shield and said conductive housing including cooperating frictionally interfitting components for mechanically and electrically securing said contact shield to said conductive housing, and for providing electrical continuity between said contact shield and said conductive housing.

11. A shielded right angle electrical connector of claim 10 wherein said cooperating interfitting components include at least one of said housing sidewalls having an open ended slot and wherein said contact shield includes at least one projecting ear extending therefrom for insertion into said sidewall slot.

12. A shielded right angle electrical connector of claim 11 wherein said slot has a transverse dimension which is less than or equal to the transverse direction of said ear for frictional receipt of said ear therein.

13. A shielded right angle electrical connector of claim 11 wherein said contact termination extents are aligned in a pair of spaced apart rows.

14. A shielded right angle electrical connector of claim 13 wherein said contact shield includes a shield wall extending between said spaced apart rows of contact termination extents.

15. A shielded right angle electrical connector of claim 14 wherein said projecting ears extend from said shield wall.

* * * * *